United States Patent [19]

Irvine et al.

[11] Patent Number: 4,753,429

[45] Date of Patent: Jun. 28, 1988

[54] COLLATING STATION FOR INSERTING MACHINE

[75] Inventors: Robert Irvine, Riverside; Harry E. Luperti, Bethel, both of Conn.

[73] Assignee: Pitney Bowes Inc., Stamford, Conn.

[21] Appl. No.: 930,216

[22] Filed: Nov. 13, 1986

[51] Int. Cl.[4] ..... B65H 39/02

[52] U.S. Cl. ..... 270/58; 226/197; 198/436; 198/457; 271/184

[58] Field of Search ..... 270/54–58; 53/266 A, 206; 226/197; 198/436, 457; 271/184

[56] References Cited

U.S. PATENT DOCUMENTS

| | | | |
|---|---|---|---|
| 3,467,370 | 9/1969 | Grantham | 493/441 X |
| 3,816,866 | 6/1974 | Miaskoff et al. | 270/58 |
| 3,936,993 | 2/1976 | Dorer | 53/266 A |
| 4,071,997 | 2/1978 | Gunther, Jr. et al. | 53/206 |
| 4,145,037 | 3/1979 | Mol | 270/58 |
| 4,169,341 | 10/1979 | Roetter et al. | 53/266 A |
| 4,266,761 | 5/1981 | Buck | 270/58 |
| 4,302,198 | 11/1981 | Kawada | 270/58 |

*Primary Examiner*—E. H. Eickholt

*Attorney, Agent, or Firm*—Lawrence E. Sklar; David E. Pitchenik; Melvin J. Scolnick

[57] ABSTRACT

A collating station is disclosed for a machine intended to insert first and second documents into an envelope. Prior to the insertion operation, the first and second documents are advanced serially in a common plane. At a predetermined location, each first document is intercepted and lifted above the common plane and moved to a holding platform spaced above the common plane. The holding platform has a transverse terminal edge downstream from where the first document comes to rest. Thereupon, the first document resting on the holding platform and a following second document which continues to advance along the common plane as the first document travels toward the holding platform are advanced together in a parallel spaced relationship, toward a downstream station. As the documents are advanced, the first document drops off the terminal edge of the holding platform and onto the second document thereby completing the collating operation. Additionally, movement of the first document is positively controlled as it is guided to locations above the common plane, thereby assuring proper collation of the first and second documents. The desired sequence of events can be achieved by means of a variable computer control, or by a fixed timing sequence built into the machine, or by sensors and associated activating devices, or by a combination of these expedients.

22 Claims, 5 Drawing Sheets

COLLATING STATION FOR INSERTING MACHINE

BACKGROUND OF THE INVENTION

I. Field of the Invention

The present invention relates to apparatus associated with a high speed inserting machine for collating different kinds of documents prior to an insertion operation.

II. Description of the Prior Art

Large volume, high speed collating and inserting machinery of the type having a series of document feeding stations located above a feed path have long been known. In such arrangements, typically, a conveyor is provided for collecting the documents from a plurality of feeding stations while collating the same and providing an envelope inserting station located downstream from the feeding stations for collectively inserting the collated documents into an envelope. Ever larger volumes of documents have created a need for ever increasing speeds of such machinery. Many of the presently commerically available collating and insertion machines operate on an intermittent or interupted basis. That is, often times, in the collection of documents at the respective feeding stations, the conveying mechanism is required to come to a full stop. Similarly, it often occurs that the conveying mechanism must come to a full stop for a subsequent insertion of the envelopes with the documents into their associated envelopes.

Such requirements for a halt in the operation at each station have been occasioned by designs that require the positive handling of the documents through clamps or opposed, closeable fingers. Of course, it will be appreciated that such expedients not only require intermittent drive operation, but also tend to skew and even occasionally tear documents. Additionally, the drive mechanisms of such intermittent operating machinery exhibit far greater wear than continuously operating machinery. The commonly assigned U.S. Pat. No. 4,169,341 to Roetter et al discloses on improvement to such apparatus and, specifically, collating and inserting apparatus that is capable of continuous operation resulting in substantially increased output.

Another drawback of the prior art resides in the fact that previously it was customary to collate a plurality of documents such that an address bearing document would be placed first in a stack of documents, face down. In this manner, when all of the documents had been fed into position and were subsequently turned over, the address bearing document would be face up and readable. The phrase "address bearing document" is taken to mean a document which recites the name and address of the person or organization to which all of the documents together are to be directed, as by the Postal Service.

Other typical conveyor systems known to the inventors are disclosed in U.S. Pat. Nos. 4,130,193 to Bourgeois and 4,499,834 to Ruetschle et al. In the Bourgeois machine, an interrupter unit is first operated to provide a gap in the flow of goods along a transferor conveyor. Thereupon, a control unit delays operation of a transfer unit until the gap created by the interrupter unit reaches the area where the transfer is to take place. At that point, when the area is free of goods, the transfer unit is operated and delivery begins from the transferor conveyor to the transferee conveyor and thence onto a subsequent operation. In the Reutschle et al machine, a plurality of sheets are fed from hoppers onto a support surface immediately ahead of a pusher finger after which the group of sheets is inspected for thickness. If the group of sheets does not pass inspection, a ramp is operated and opposed belts receive the group of sheets from the ramp and deposit them on a receiving tray positioned above the support surface for subsequent removal from the system.

SUMMARY OF THE INVENTION

It was with knowledge of the prior art and the problems existing which gave rise to the present invention. According to the invention, an improved collating station is disclosed for use with an inserting machine intended to insert first and second documents into an envelope. Prior to the insertion operation, the first and second documents are advanced serially in a common plane. At a predetermined location, each first document is intercepted and lifted above the common plane and, in a positive fashion, moved to a holding platform spaced above the common plane. The holding platform has a transverse terminal edge downstream from the location at which the first document comes to rest. Thereupon, the first document resting on the holding platform and a following second document which continues to advance along the common plane as the first document travels toward the holding platform are advanced together, now in a parallel spaced relationship, toward a downstream station. As the first and second documents are advanced, the first document drops off the terminal edge of the holding platform and onto the second document thereby completing the collating operation.

The operation insures that information presented on the face of the first document desirably remains visible throughout the operation and upon the completion of the operation. Additionally, movement of the first document is positively controlled as it is guided to locations above the common plane, thereby assuring proper collation of the first and second documents. Also, the present invention provides a machine capable of high speed, continuous operation in contrast to many known inserting machines which operate on an intermittent or interrupted basis. The desired sequence of events performed by the various components can be achieved by means of a variable computer control, or by a fixed timing sequence built into the machine, or by sensors and associated activating devices, or by a combination of these expedients.

The present invention can be used in association with a large variety of conveyor mechanisms in situations requiring collation of a plurality of different kinds of documents. One improved form of machine with which the invention may be associated is that disclosed in commonly assigned copending U.S. patent application Ser. No. 909,663 filed Sept. 22, 1986 entitled "Transfer Apparatus for an Inserting Machine", invented by Harry Luperti.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings which are incorporated in, and constitute a part of this invention, illustrate some of the embodiments of the invention and, together with the description, serve to explain the principles of the invention in general terms.

DETAILED DESCRIPTION OF THE DRAWINGS

DETAILED DESCRIPTION OF THE PREFERRED EMBODIMENT

Figure 1:
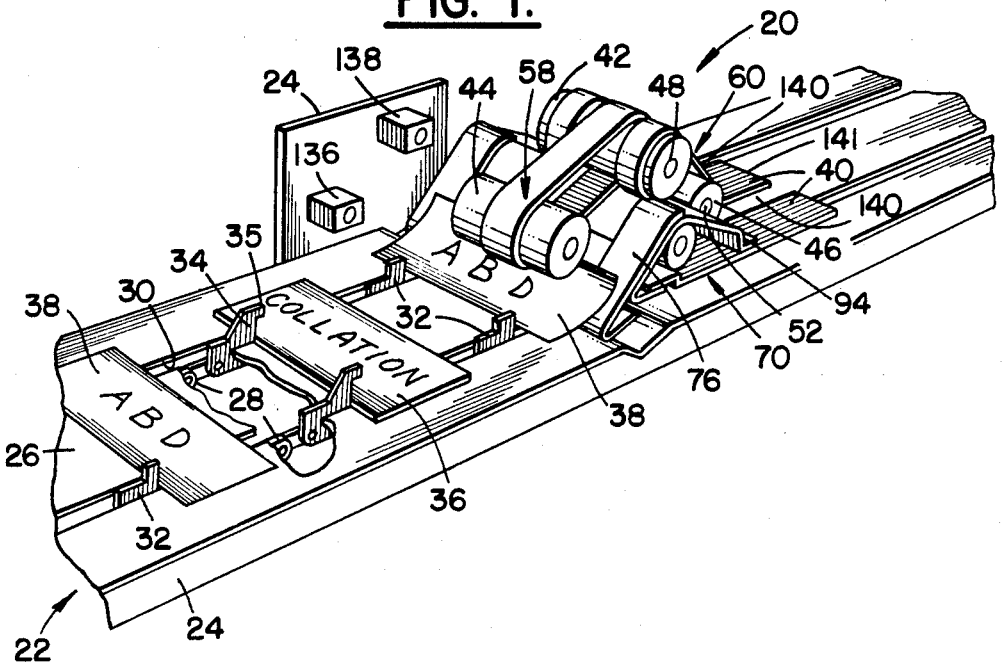
FIG. 1 is a detail perspective view of a collating station for a document collating and inserting machine embodying the present invention and illustrating an event occurring in the operation of the machine.
Figure 2:
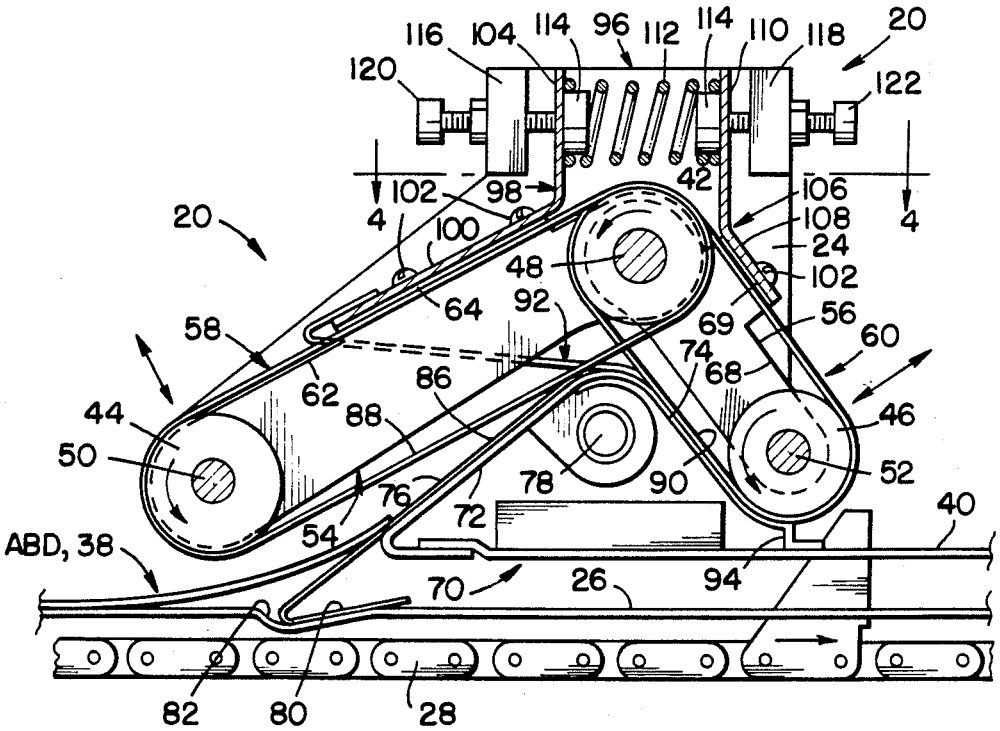
FIG. 2 is a detail side elevation view of the collating station of FIG. 1, certain parts being cut away and shown in section, depicting the same event illustrated in FIG. 1.

Turn now to the drawings and initially to FIGS. 1 and 2 which are illustrative of a collating station 20 which can be used in conjunction with a document collating and inserting machine 22 of the nature disclosed in commonly assigned U.S. Pat. Nos. 4,020,615 issued to Irvine et al on May 3, 1977 and 4,541,764 issued to Govan et al on Sept. 17, 1985 the disclosures of which are hereby incorporated herein by entirety.

Figure 3:
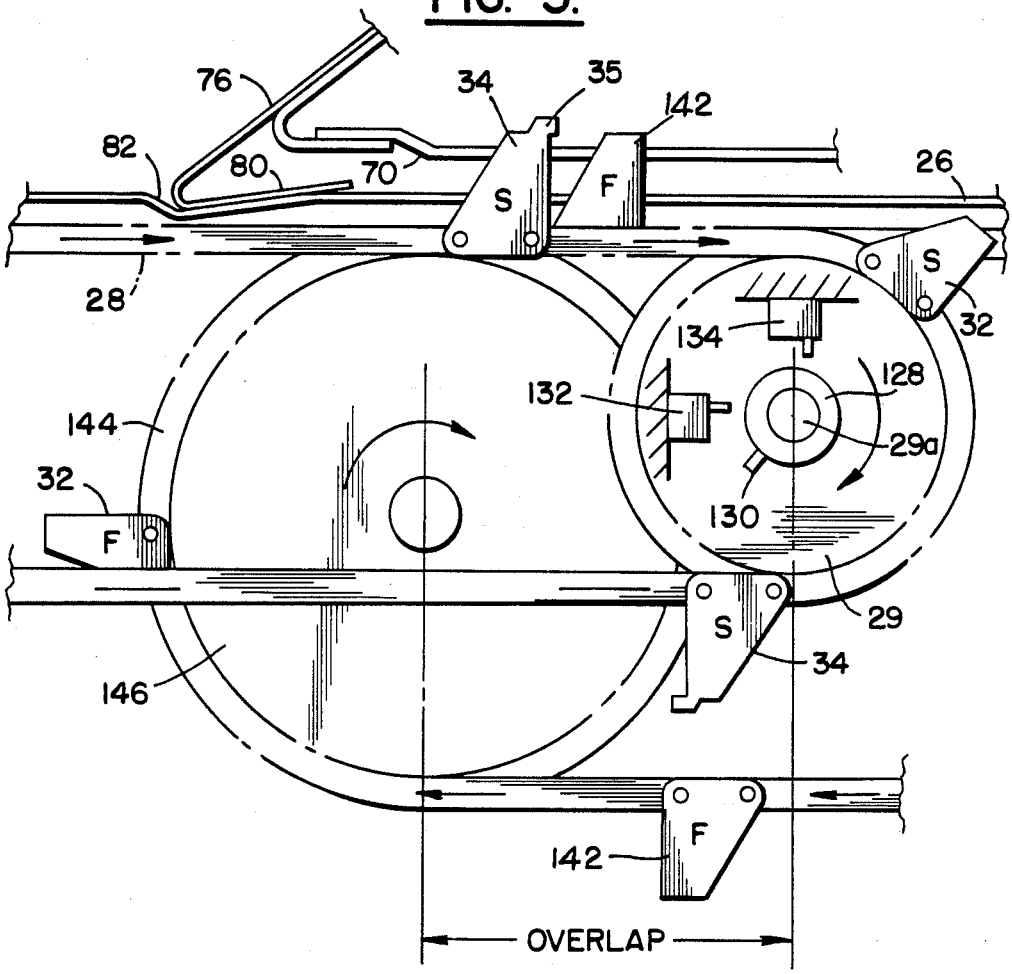
FIG. 3 is a detail side elevation view of a portion of the drive mechanism for the inserting machine.

In the present instance, the machine 22 has a frame or housing 24 with a longitudinally extending deck 26. For purposes of orientation, the right of the apparatus as seen in FIG. 1 will be referred to as the downstream end and the left of the apparatus as the upstream end for reasons that will become apparent. Disposed along the length of the machine 22 is a conveyor assembly as partially represented by a pair of parallel chains 28 (FIGS. 1, 2, and 3). Upstream of that portion of the machine 22 illustrated in FIG. 1, sheets to be collated are normally a sorted set of the same document whereby each of a plurality of feeding stations will feed documents to the same location in the same time sequence. The documents will be received at an associated holding platform where they may be sequentially removed by pushers arranged in pairs on the moving document conveyor.

In this manner, a document fed by a station at the upstream end of the document conveyor will be received on a first holding platform and then moved therefrom by the pusher members onto the conveyor. The next document feeding station will have deposited a document from a second feeding station onto a second holding platform whereafter that document will then be moved therefrom by the pusher members on the conveyor atop the previously deposited document. Thereafter, the subsequent downstream feeding stations will sequentially feed single documents from their stack of documents onto the previously deposited documents whereby the conveyor and the sheet feed stations will function to form collated sets of documents on the conveyor for being transported.

In order to function properly, the collated sets must be separated with a space to allow the presence of a pusher pair between each collated set. The space between sets is also limited by the space taken up by each feeding station. In the interest of space and economy, the feeding stations should be as close together as possible and, therefore, the pusher pairs should be as close together as possible. Any number of collating stations may be utilized together as a function of the number of sheets desired in a set of collated documents.

As noted above, all of the foregoing operations occur upstream of that portion of the apparatus illustrated in FIG. 1.

Downstream from the collating station 20 is an envelope inserting or stuffing station (not shown). This station includes the apparatus for receiving, supporting, and sequentially feeding envelopes, one at a time, into the document feed path at an area adjacent the downstream portion of the conveyor. The stuffing station is constructed for positioning envelopes, one at a time, for receiving therein a collated set of documents. Then, after each envelope is sequentially stuffed by having a collated set of documents inserted into the fixed envelope, the stuffed envelope is conveyed to the downstream end of the conveyor, then transported to a temporary holding location to await subsequent appropriate operations.

As mentioned above, with continuing reference to FIGS. 1–3, the conveyor assembly includes a pair of spaced parallel chains 28 driven and moveable in an endless path of motion by both longitudinally and laterally spaced sprockets 29, that is, the sprockets are positioned side by side and at each end of the conveyor. The chains have an upper path of movement along the document feed path, just beneath the deck 26. The chains then have a lower path of movement along their return path. The chains are supported at their opposite ends (only one end is shown in FIG. 3) by appropriate cylindrical sprockets 29 and supporting shafts 29*a* to which the sprockets are keyed for concurrent rotational movement. Thus, there is a radially separated sprocket pair 29 located at both the upstream and downstream ends of the conveyor. Additionally, at each conveyor end, the sprockets of each pair are axially displaced on its shaft an appropriate distance to allow contact with the edges of the document being transported.

As seen in FIG. 1, the deck 26 is formed with a pair of parallel, spaced apart. longitudinally extending slots 30 through which pairs of first feed fingers 32 and second feed fingers 34 extend. The feed fingers 32 and 34, in associated pairs, are located on the chains 28 and extend radially outwardly from the chains to intercept, contact, push, and transport documents along the deck 26. The feed finger pairs are spaced a sufficient distance along the direction of conveyor and document travel so as to create a space between each collated set of documents being transported. The feed fingers, chains and sprockets are axially spaced sufficiently to contact the edges of the conveyed documents to properly effect their transportation. Each feed finger 34 is preferably provided with forwardly extending projections 35 adjacent its remote end to assist in receiving and holding a stack of documents being transported.

The feed fingers 32 are longitudinally spaced at regular intervals along the length of the deck 26. Similarily, feed fingers 34 are longitudinally spaced at regular intervals along the length of the deck 26 and are positioned intermediate the first feed fingers 32. Thus, at the upstream feed stations mentioned above, a plurality of documents in the form of a stack or collation 36 will have been placed on the deck 26 in front of each pair of feed fingers 34. Once placed on the deck 26, the collation 36 is continuously advanced from the left toward the right thereon. Just as the collation 36 is placed on the deck 26 in front of the feed fingers 34 at an upstream location, so too, a document 38 which may be in the nature of an address bearing document associated with each collation 36, will have been placed on the deck 26 in front of an associated pair of the feed fingers 32 for advancement along the deck 26.

In FIG. 1, successive sets of collations 36 and documents 38 are seen being advanced along the deck 26 and eventually to and through the collating station 20. The function of the collating station 20, which is about to be described, is to place each document 38, in its face-up attitude, on top of its associated stack or collation 36. In brief, as each document 38 is advanced along the deck 26 by its associated pair of first feed fingers 32 and enters the collating station 20, it is raised above the plane of the deck 26 and deposited on a platform 40. Thereafter, the document 38 is withdrawn and deposited on the top of its associated collation 36 which, in the meantime, has continued to be advanced by the feed fingers 34 on the deck 26. The specific mechanism which achieves this result will now be described.

Turning back, once again, to FIGS. 1 and 2, the collating station 20 is seen to generally overlie the deck 26 of the machine 22. The heart of the collating station 20 comprises three cylindrical drums which, for purposes of differentiation, will be referred to as a first drum 42, a second drum 44, and a third drum 46. Each of the drums is rotatable about a transversely extending axis lying in a plane parallel to the deck 26, but spaced therefrom. A drive shaft 48 is journaled on the frame 24 and powered in a suitable fashion so as to drive the drum 42 in a counterclock-wise direction as indicated in FIG. 2. The axis of the drive shaft 48, and therefore of the drum 42, is spaced above the deck 26 by a distance greater than that of the axes for either drums 44 or 46. The drum 44 is rotatably supported on an idler shaft 50 and the drum 46 is rotatably mounted on an idler shaft 52. Both of the idler shafts are suitably supported on first and second saddle members, 54 and 56, respectively (see especially FIG. 4). As can be readily seen in FIG. 2, the axis of the shaft 50 is spaced above the deck 26 by a distance which is less than that of either shaft 52 or shaft 48.

Figure 4:
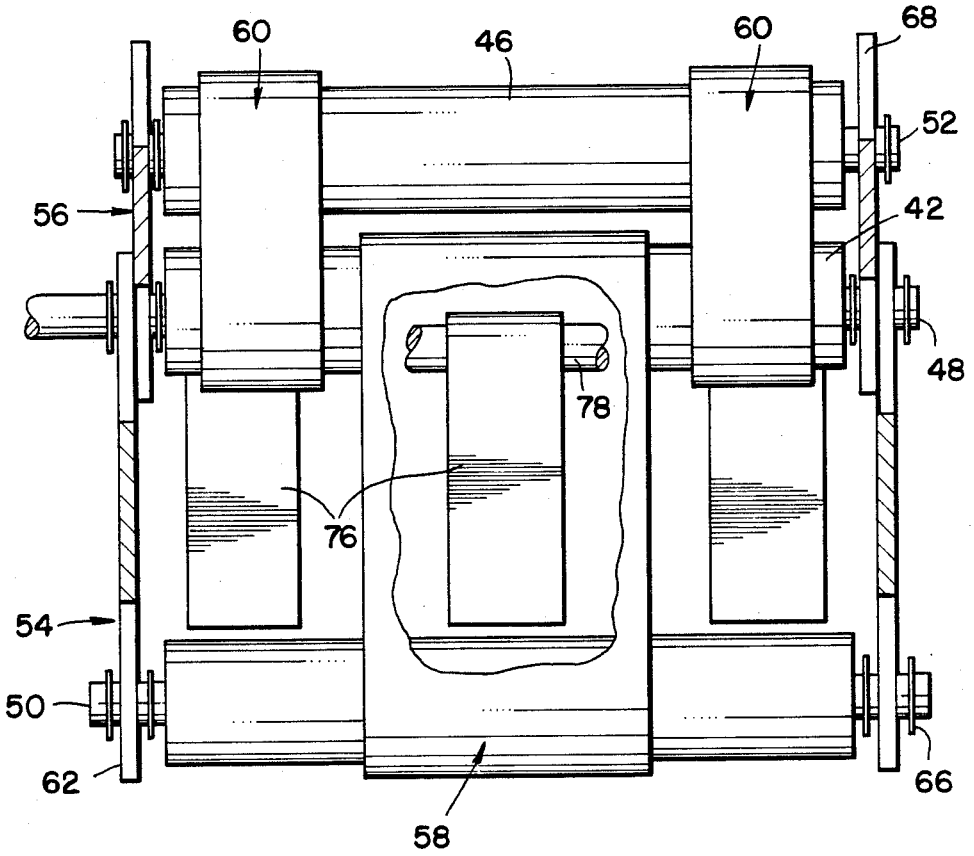
FIG. 4 is a detail top plan view of parts illustrated in FIGS. 1 and 2.
Figure 6:
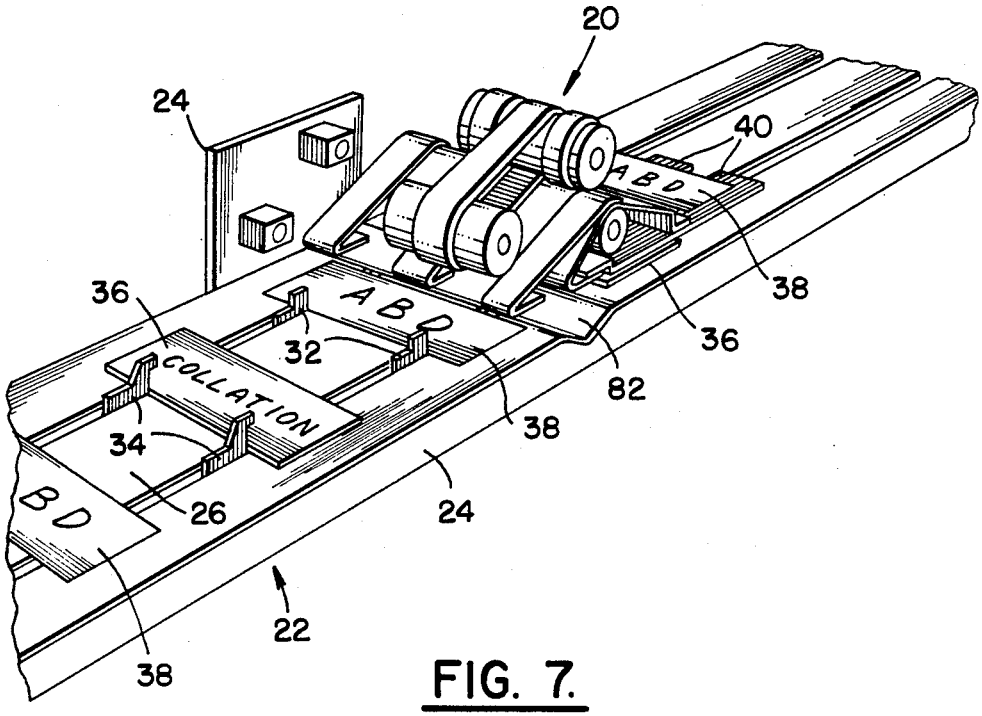
FIG. 6 is a detail perspective view, similar to FIG. 1, illustrating a later event occurring in the operation of the machine.

As seen in FIGS. 1, 2, and 4, a suitable continuous drive belt 58 is drivingly received on the first and second drums, 42 and 44, respectively, such that rotation of the drum 42 imparts movement to the drive belt 58 and, in turn, rotation of the second drum 44.

The third drum 46, which is downstream of the first drum 42, is similarily driven by a pair of continuous driven belts 60 which is drivingly received on the first and third drums, 42 and 46, respectively, such that rotation of the first drum 42 imparts movement to the drive belt 60 and, in turn, rotates the third drum 46. As best seen in FIG. 4, the drive belts 60 straddle the drive belt 58 on the drum 42. Although only one first drive belt 58 and only two drive belts 60 are illustrated, it will be appreciated that other numbers and combinations of belts can be employed. As one such example, the belt 58 may be replaced with three individual spaced apart belts with the two belts 60 positioned therebetween on the drum 42.

It was previously noted that the idler shaft 50 supporting the second drum 44 is itself supported on the first saddle member 54. To be more specific, ends of the shaft 50 are suitably journaled on spaced apart, generally upright, sidewalls 62 of the saddle member 54, an integral bridge member 64 extending between the sidewalls 62. The end of the saddle member 54 distant from the idler shaft 50 is supported on the shaft 48 in a suitable manner which does not adversely affect rotation of the drive shaft 48. Belleville washer 66, or other suitable retaining means, are employed to maintain proper relative positioning of the sidewalls 62 and the shafts 48 and 50.

In a similar fashion, the saddle member 56 has sidewalls 68 which are suitably mounted on the drive shaft 48 and themselves support the idler shaft 52 for rotation thereon. As with the saddle member 54, the saddle member 56 includes an integral bridge member 69 which extends between the sidewalls 68.

Figure 5:
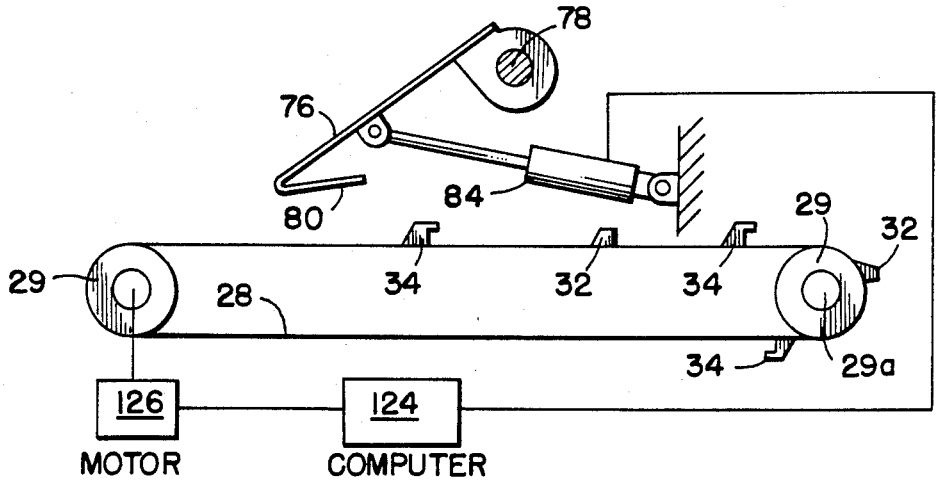
FIG. 5 is a diagrammatic side elevation view, including components illustrated in FIGS. 1 and 2, depicting the operation of the invention.
Figure 7:
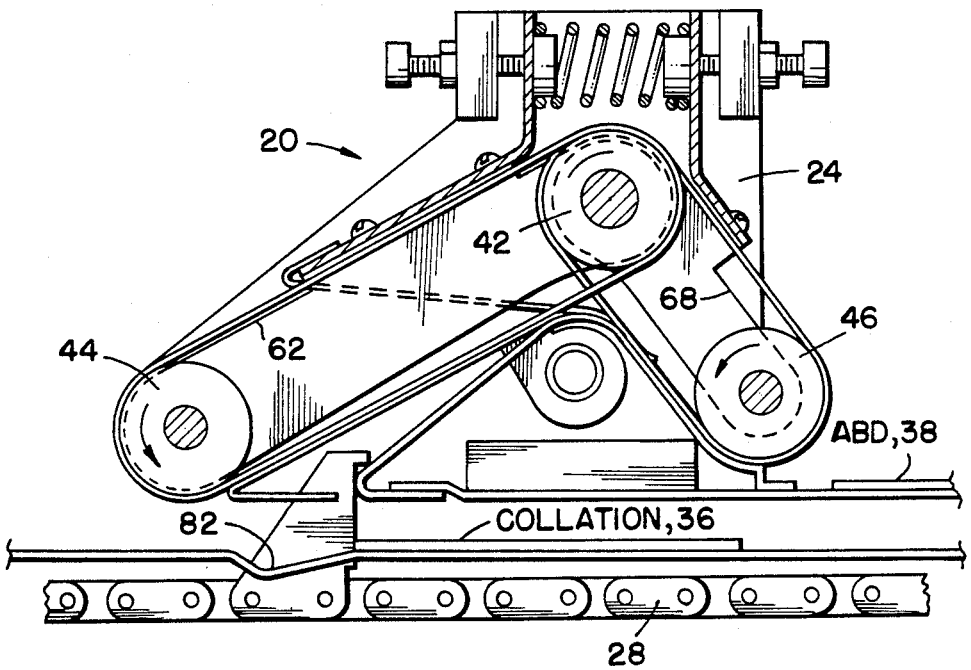
FIG. 7 is a side elevation view, similar to FIG. 2, depicting the same event illustrated in FIG. 6.
Figure 8:
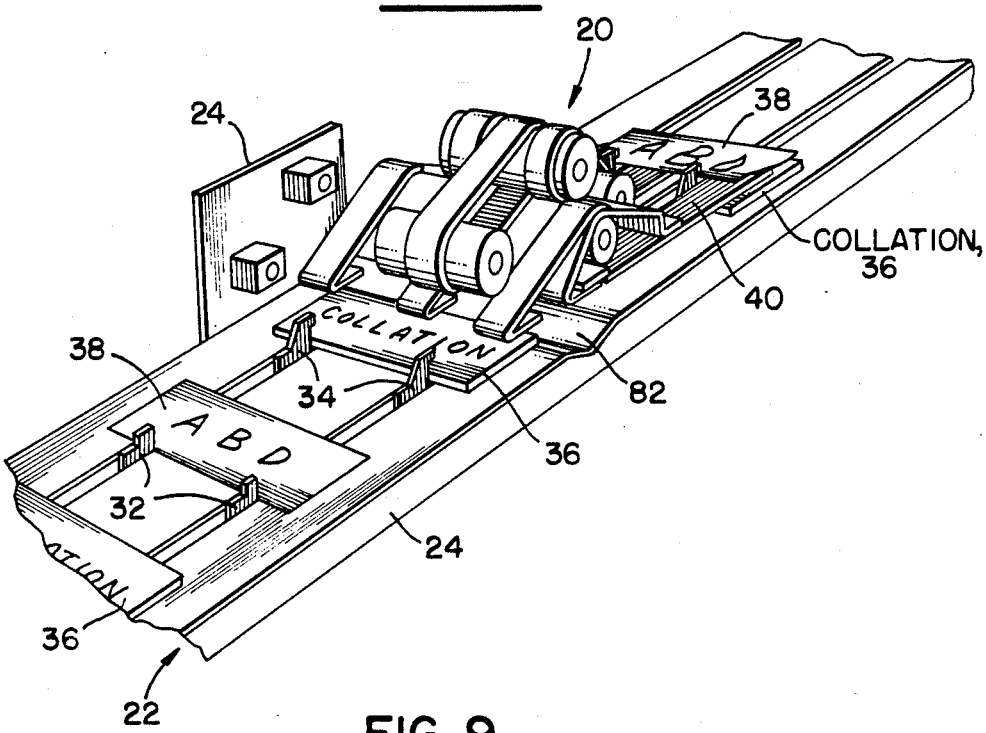
FIG. 8 is a detail perspective view, similar to FIGS. 1 & 6, illustrating still a later event occurring in the operation of the machine.
Figure 9:
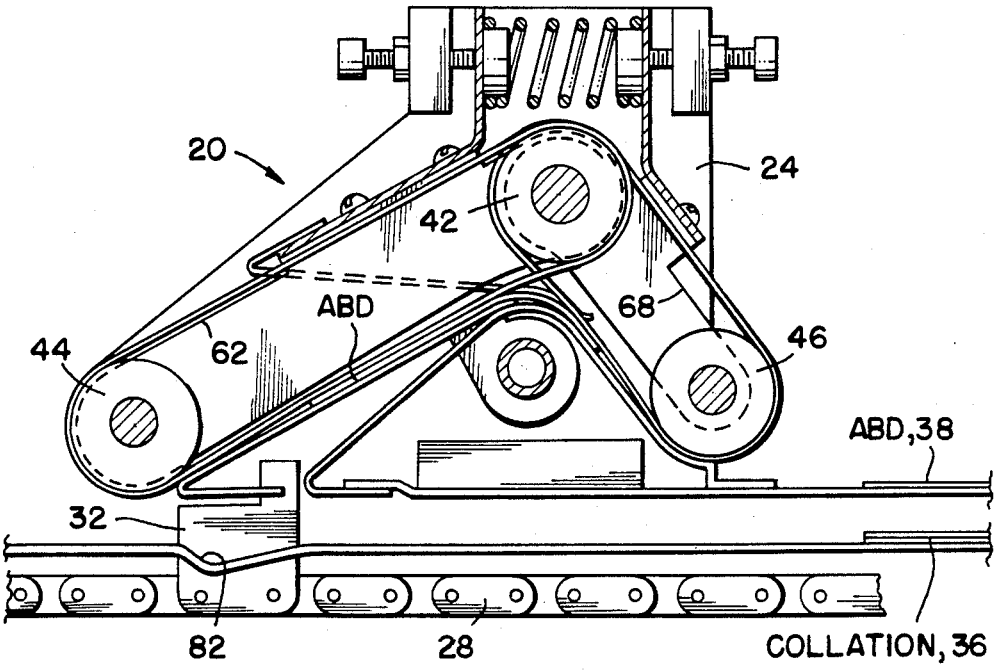
FIG. 9 is a side elevation view, similar to FIGS. 2 & 7, depicting the same event illustrated in FIG. 8.

Overlying the deck 26, but positioned beneath the belts 58 and 60 is a transitional structure generally indicated at 70 integral with the frame 24 (see FIGS. 1 and 2). The transitional structure 70 includes a ramp support member 72 on its upstream side and an intermediate or transitional member 74 on its downstream side. A ramp 76 formed of sheet metal, or other suitable material, is pivotally mounted on a cross shaft 78 which may journaled at its opposite ends on the frame 24. The ramp 76 may be discontinuous in the transverse direction, as seen in FIGS. 1 and 4, and may be fixed to the shaft 78 through appropriate slots (not shown) formed in the transitional structure 70. A lower end of the ramp is bent rearwardly to form a foot 80 which is receivable in a laterally disposed depression 82 formed in the deck 26. When the foot 80 is engaged with the depression 82 as illustrated in FIG. 2, the ramp 76 is supportively engaged with the support member 72. As seen in FIG. 5, the ramp 76 is moveable by means of a solenoid 84 between a lowered, or active, position as illustrated in FIG. 2 and a raised, or inactive position as illustrated in FIG. 7.

Thus, as an address bearing document 38 approaches the region of the drum 44, control means, which will be described below, is operated to cause the solenoid 84 to retract, thereby lowering the ramp 76 to the position indicated in FIG. 2. As they continue to advance, the feed fingers 32 are effective to push the document 38 up the ramp 76 and into a nip 86 defined between a lower run 88 of the belt 58 and the ramp 76. With the belt moving in a counterclockwise direction (FIG. 2), it engages the document 38 and draws it toward a lower run 90 of the belt 60.

A document guide member 92 which will be more completely described below is engaged by the document 38 as its passes through and beyond the nip 86 and serves to hold the document gently, but firmly, against the transitional structure 70. Specifically, the guide member 92 assures proper movement of the document 38 from the ramp 76 onto the outer surface of the transitional member 74. As the document 38 moves onto the transitional member 74, it is engaged by the lower run 90 of the belt 60 which, like the belt 58, is moving in a counterclockwise direction (see FIG. 2). The document 38 advances along the surface of the transitional member 74 until it reaches the end thereof as defined by a step 94 and drops onto the platform 40.

An adjustment mechanism 96 is provided to adjust the bearing pressure of the lower run 88 against the ramp 76, the bearing pressure of the lower run 90 against the transitional member 74, and the bias of the document guide member 72 generally against the transitional structure 70. To this end, a first bracket 98 is provided having a lower leg 100 fixed to the bridge member 64 as by suitable fasteners 102, as well as a foremost upstanding leg 104. In a similar construction, a second bracket 106 has a lower leg 108 fixed to the bridge member 69 as by suitable fasteners 102. The second bracket 106 also has an aft upstanding leg 110 which is substantially parallel to and coextensive with the upstanding leg 104. A compression spring 112 extends between the upstanding legs 104 and 110 and is maintained in proper alignment by means of suitable bushings 114 integral with the legs 104 and 110.

Suitably threaded ear members 116 and 118 extend outwardly from the frame 24 and receive appropriate screw members 120 and 122, respectively. The tip end of the screw member 120 engages leg 104 and the tip end of the screw member 122 engages the leg 110. It will be appreciated that as the screw member 120 is withdrawn from the ear member 116, the spring 112 urges the bracket 98, and with it the saddle member 54, in a counterclockwise direction about the shaft 48. This has the effect of increasing bearing pressure of the lower run 88 against the ramp 76. Conversely, by screwing the screw member 120 into the ear member 116, the bearing pressure between the lower run 88 and the ramp 76 is decreased.

In a similar fashion, by withdrawing the screw member 122 from the ear member 118, the spring 112 urges the bracket 106, and with it the saddle member 56, in a clockwise direction about the shaft 48 thereby increasing the pressure of the lower run 90 against the upper surface of the transitional member 74.

Conversely, by screwing the screw member 122 into the ear member 118, the bearing pressure of the lower run 90 against the outer surface of the transitional member 74 is reduced. In this manner, adjustments can be made to accommodate varying thicknesses of the document 38 as well as tolerances, temperature and atmospheric conditions.

The operation of the machine 22 can be controlled by means of a computer 124 which may adjust the speed of a variable speed motor 126 in accordance with a desired program. The motor 126, as seen in FIG. 5, is operable to drive one set of sprockets 29 and, with them, the chains 28. The computer 124 is also effective to operate other components of the machine, including the solenoid 84, in accordance with the speed chosen for operating the motor 126.

As seen in FIG. 3, a suitable encoder in the form of a disk 128 is keyed on the shaft 29*a*. The disk 128 has an integral radially extending whisker 130 which, with rotation of the shaft 29*a*, is engageable with the operating lever of a first microswitch 132, then with the operating lever of a second microswitch 134. Also, the machine 22 is provided with a pair of suitable sensors 136, 138 which are mounted on the frame 24 so as to scan across the path of the documents advancing along the deck 26. Thus, viewing FIGS. 1-3, as an address bearing document 38 reaches a position on the deck 26 at which its leading edge is coextensive with first sensor 136, the computer 124 is notified accordingly, and the computer causes the solenoid 84 to be energized to move the ramp 76 to its lowered, active position as seen in FIGS. 1 and 2. Then, as the document 38 ascends the ramp 76, it reaches a position at which its leading edge is detected by the second sensor 138. The sensor 138, in turn, informs the computer 124 that the document 38 is present in the ramp 76 whereupon the computer causes the solenoid 84 to be deenergized, returning the ramp 76 to its raised, inactive position.

The collation 36 which continues to advance along the deck 26 has no effect on the sensor 136 as did the document 38. This is due to the specialized construction of the encoder disk 128 and its relative positioning on the shaft 29*a*. Specifically, the disk 128 is so positioned that immediately before the leading edge of a document 38 is aligned with the sensor 136, the whisker 130 will have activated the microswitch 132 which, in turn, causes the sensor 136 to be energized. Then, immediately following detection of the leading edge of the document 38 by the sensor 138, the whisker 130 will have operated the microswitch 134 to deenergize the sensor 136. Thus, the collation 36 will continue along the deck 26 and beneath the transitional structure 70 without affecting the sensor 136.

By the time an address bearing document 38 reaches the platform 40, its previously associated feed fingers 32 will have advanced beyond the platform 40 and out of position to again engage the document 38. However, the feed fingers 34 which are advancing the following collation 36 continue to advance through appropriate slots 140 in the transitional member 74. When they reach the platform 40, the feed fingers 34 will engage the trailing edge of the document 38 and push it beyond a terminal edge 142 of the platform 40 and onto the collation 36. Thereafter, the address bearing document 38 remains atop the collation 36 as it exits from the collating station 20.

As seen in FIG. 3, the feed fingers 32 and 34 are withdrawn from the deck 26 immediately downstream of the collating station 20 since the sprocket 29 represents the terminal end of the conveyor assembly associated with the collating station 20. However, in a timed relationship with the feed fingers 34, pusher elements 142 suitably mounted on a chain 144 drivingly supported on a sprocket 146 then engage the combined document 38 and collation 36 and advance it farther downstream from the collating station 20. There is an overlap, as seen in FIG. 3, of the chains 28 and 144 which permits this to occur. Furthermore, it is preferable that the translational speed of the pusher elements 142 be substantially greater than that of the feed fingers 34 so as to guard against any possible backup of documents just beyond the collating station 20. As previously noted, the pusher elements 142 operate to direct the newly joined combination of document 38 and collation 36 to a location at which the latter will be inserted into an appropriate envelope.

While a preferred embodiment of the invention has been disclosed in detail, it should be understood by those skilled in the art that various modifications may be made to the illustrated embodiment without departing from the scope as described in the specification and defined in the appended claims.

What is claimed is:

1. Collating apparatus in a document feeding and inserting machine having a plurality of document feeding stations and a conveying path along which alternating stacks of enclosure documents and address bearing documents are continuously advanced towards an inserting station containing envelopes, said collating apparatus comprising:

a substantially elongate, horizontal support for guiding the stacks of enclosure documents and address bearing documents along said conveying path;

conveying means having alternating, spaced apart, tall and short pusher members for urging the alternating stacks of enclosure documents and address bearing documents, respectively, towards the inserting station;

frame means for supporting said conveying means and said substantially elongate, horizontal support;

an overlying platform mounted on said frame means and located in a substantially parallel relationship with respect to said conveying path;

scanning means for identifying the address bearing documents;

diverting means operational upon receiving a signal from said scanning means for intercepting and temporarily storing an address bearing document on said overlying platform; and means for collecting each of the stored address bearing documents and for depositing the documents on top of the stack of enclosure documents which is being pushed by said tall pusher members located immediately following each of said short pusher members, thereby collating each of the address bearing documents with each of the stack of documents for insertion into an envelope at the inserting station.

2. Collating apparatus as set forth in claim 1 wherein said diverting means includes:

a ramp movable between an inactive position to permit uninterrupted advancement of the documents along said elongate surface, and an active position;

moving belt means cooperable with said ramp when said ramp is in the active position to form a nip therebetween for receiving the first document from said first feed means, said belt means being frictionally engageable with the first document so as to firmly bias the first document against said ramp and thereby positively guide the first document toward and onto said holding platform.

3. Collating apparatus as set forth in claim 2 including:

a fixed transitional surface adapted to receive thereon a first document, said transitional surface overlying said elongate surface intermediate said holding platform and said ramp when said ramp is in the active position, said belt means firmly biasing the first document against said transitional surface when the first document advances to a position intermediate said ramp and said holding platform.

4. Apparatus as set forth in claim 3 including:

actuating means for selectively moving said ramp between the active and inactive positions.

5. Apparatus as set forth in claim 4 wherein said actuating means includes:

first sensor means positioned adjacent the path of advancement of the documents at a location prior to a document reaching said diverting means, said sensing means being operable to detect the presence of each advancing first document; and solenoid means responsive to operation of said first sensing means for moving said ramp from the inactive position to the active position.

6. Apparatus as set forth in claim 5 wherein said actuating means includes:

second sensor means positioned adjacent the path of advancement of the first documents along said ramp in its active position, said second sensor means being operable to detect the presence of each advancing first document;

said solenoid means responsive to operation of said second sensing means for moving said ramp from the active position to the inactive position.

7. Apparatus as set forth in claim 6 including:

auxiliary guide means biasing each first document into positive engagement with said ramp and with said transitional surface.

8. Apparatus for collating first and second documents advancing serially in a common plane, comprising:

first feed means engageable with the first document and operable for advancing the first document toward a collating station, said first feed means including a plurality of first pusher fingers;

second feed means engageable with the second document and operable for advancing the second document in the common plane to the collating station, said second feed means including a plurality of second pusher fingers;

a holding platform at the collating station lying in a plane above the common plane for temporarily receiving the first document and having a terminal edge transverse to the direction of travel of the first and second documents;

a substantially level elongate surface over which the first and second documents are advanced by said first and second feed means;

transfer means at the collating station for withdrawing the first document from said first feed means and lifting it out of the common plane, then guiding it along a defined course terminating at said holding platform, said transfer means having a ramp movable between an inactive position to permit uninterrupted advancement of the documents along said elongate surface and an active position;

moving belt means cooperable with said ramp when said ramp is in the active position to form a nip therebetween for receiving the first document from said first feed means, said belt means being frictionally engageable with the first document so as to firmly bias the first document against said ramp and thereby positively guide the first document toward and onto said holding platform;

flexible, elongated drive means mounting said first pusher fingers at predetermined spaced locations thereon and said second pusher fingers at predetermined spaced locations thereon intermediate said first pusher fingers for movement along said elongate surface;

actuating means selectively operable for moving said ramp between the active and inactive positions; and timing means effective for coordinating operation of said actuating means with the position of each of said first and second fingers whereby said ramp is moved to the active position when one of said first fingers is at a predetermined location prior to reaching the collating station and whereby said ramp is moved to the inactive position when one of said second fingers is at a predetermined location prior to reaching the collating station, and said second feed means being engageable, upon continued operation thereof, with the first document as the first document is positioned on said holding platform and being operable for advancing the first document across said terminal edge and downwardly onto the second document such that the first document overlies the second document in a parallel, contiguous relationship.

9. Apparatus as set forth in claim 8 including:

a fixed transitional surface adapted to receive thereon a first document, said transitional surface overlying said elongate surface intermediate said holding platform and said ramp when said ramp is in the active position, said belt means firmly biasing the first document against said transitional surface when the first document advances to a position intermediate said ramp and said holding platform.

10. Apparatus as set forth in claim 8 wherein said actuating means includes:

first sensor means positioned adjacent the path of advancement of the documents at a location prior to a document reaching the collating station, said sensing means being operable to detect the presence of each advancing first document; and solenoid means responsive to operation of said first sensing means for moving said ramp from the inactive position to the active position.

11. Apparatus as set forth in claim 10 wherein said actuating means includes:

second sensor means positioned adjacent the path of advancement of the first documents along said ramp in its active position, said second sensor means being operable to detect the presence of each advancing first document;

said solenoid means responsive to operation of said second sensing means for moving said ramp from the active position to the inactive position.

12. Apparatus as set forth in claim 9 including:

auxiliary guide means biasing each first document into positive engagement with said intermediate surface.

13. Apparatus for collating first and second documents advancing serially in a common plane comprising:

first feed means engageable with the first document and operable for advancing the first document toward a collating station;

second feed means engageable with the second document and operable for advancing the second document in the common plane to the collating station;

a holding platform at the collating station lying in a plane above the common plane for temporarily receiving the first document and having a terminal edge transverse to the direction of travel of the first and second documents;

transfer means of the collating station for withdrawing the first document from said first feed means and lifting it out of the common plane, then guiding it along a defined course terminating at said holding platform;

said second feed means being engageable, upon continued operation thereof, with the first document as the first document is positioned on said holding platform and being operable for advancing the first document across said terminal edge and downwardly onto the second document such that the first document overlies the second document in a parallel contiguous relationship;

a substantially level elongate surface over which the first and second documents are advanced by said first and second feed means from an upstream and toward a downstream end;

a first cylindrical drum rotatable about a transversely extending axis lying in a plane parallel to said elongate surface and spaced therefrom by a first distance;

drive means including a drive shaft journaled on said frame for rotating said first drum;

a second cylindrical drum upstream of said first drum and rotatable about an axis parallel to the axis of said first drum and spaced from said elongate surface by a second distance less than said first distance;

first continuous belt means drivingly received on said first and second drums such that rotation of said first drum imparts movement to said first belt means and, in turn, rotation of said second drum;

a third cylindrical drum downstream of said first drum rotatable about an axis parallel to the axis of said first and second drums and spaced from said elongate surface by a distance less than said second distance;

second continuous belt means drivingly received on said second and third drums such that rotation of said second drum imparts movement to said second continuous belt means and, in turn, rotation of said third drum;

a ramp movable between an inactive position to permit uninterrupted advancement of the documents along said elongate surface, and an active position; and a fixed transitional surface adapted to receive thereon a first document, said transitional surface overlying said elongate surface intermediate said holding platform and said ramp when said ramp is in the active position, said first continuous belt means being cooperable with said ramp when said ramp is in the active position to form a nip therebetween for receiving the first document from said first feed means, said first belt means being frictionally engageable with the first document so as to firmly bias the first document against said ramp and to advance the first document toward engagement by said second belt means, and said second belt means being frictionally engageable with the first document so as to bias the first document so as to bias the first document against said transitional surface and thereby positively advance and guide the first document onto said holding platform.

14. Apparatus as set forth in claim 13 including:

actuating means for selectively moving said ramp between the active and inactive positions.

15. Apparatus as set forth in claim 14 wherein said actuating means includes:

first sensors means positioned adjacent the path of advancement of the documents at a location prior to a document reaching said ramp, said sensing means being operable to detect the presence of each advancing first document; and solenoid means responsive to operation of said first sensing means for moving said ramp from the inactive position to the active position.

16. Apparatus as set forth in claim 15 wherein said actuating means includes:

second sensor means positioned adjacent the path of advancement of the first documents along said ramp in its active position, said second sensor means being operable to detect the presence of each advancing first document;

said solenoid means responsive to operation of said second sensing means for moving said ramp from the active position to the inactive position.

17. Apparatus as set forth in claim 16 including:

auxiliary guide means guiding each first document from said ramp onto said intermediate surface and biasing each first document into positive engagement with said intermediate surface.

18. Apparatus as set forth in claim 13 wherein said first belt means includes:

a first belt run contiguous with said ramp when said ramp is in the active position;

wherein said second belt means includes:

a second belt run contiguous with said transitional surface; and including:

adjustment means associated with said first, second and third drums for selectively adjusting the pressure of said first belt run against said ramp and the pressure of said second belt run against said transitional surface.

19. Apparatus as set forth in claim 13 including:

a first saddle member including spaced apart, generally upright, sidewalls and an integral bridge member extending between said sidewalls, said first saddle member being pivotally mounted on said drive shaft;

a first idler shaft mounted on said first saddle member upstream of said drive shaft and extending transversely of said elongate surface, said first drum being rotatably mounted on said first idler shaft;

a second saddle member including spaced apart, generally upright, sidewalls and an integral bridge member extending between said sidewalls, said second saddle member being pivotally mounted on said drive shaft; and a second idler shaft mounted on said second framework downstream of said drive shaft and extending transversely of said elongate surface, said third drum being rotatably mounted on said second idler shaft.

20. Apparatus as set forth in claim 19 wherein said first belt means includes:

a first belt run contiguous with said ramp when said ramp is in the active position;

wherein said second belt means includes:

a second belt run contiguous with said transitional surface; and including:

adjustment means on said frame for selectively moving said first and second saddle members to thereby adjacent the pressure of said first belt run against said ramp and the pressure of said second belt against said transitional surface.

21. Apparatus as set forth in claim 20 wherein said adjustment means includes:

a first bracket having a lower leg fixed to said bridge member of said first saddle member and a foremost upstanding leg;

a second bracket having a lower leg fixed to said bridge member of said second saddle member and an aft upstanding leg;

said upstanding legs of said first and second brackets being generally coextensive;

resilient means intermediate said upstanding legs biasing them apart;

first and second screw means threadedly mounted on said frame, said first screw means having a tip end engaged with said foremost upstanding leg, said second screw means having a tip end engagd with said aft upstanding leg;

whereby withdrawal of said tip end of said first screw means causes said resilient means to pivot said first saddle member downwardly about said drive shaft to thereby increase the pressure of said first belt run against said ramp; and whereby withdrawal of said tip end of said second screw means causes said resilient means to pivot said second saddle member downwardly about said drive shaft to thereby increase the pressure of said second belt run against said transitional surface.

22. Apparatus as set forth in claim 19 including an elongated resilient member having a support end fixed to said bridge member of said first framework and a working end for guiding each first document from said ramp onto said intermediate surface and biasing each first document into positive engagement with said transitional surface.

* * * * *